US006217199B1

(12) United States Patent
Lo et al.

(10) Patent No.: US 6,217,199 B1
(45) Date of Patent: Apr. 17, 2001

(54) LAMP WITH SAFETY FEATURES

(75) Inventors: David Lo, Taipei (TW); Francis E. Marino, Upton, MA (US)

(73) Assignee: The Holmes Group, Inc., Milford, MA (US)

( * ) Notice: Subject to any disclaimer, the term of this patent is extended or adjusted under 35 U.S.C. 154(b) by 0 days.

(21) Appl. No.: 09/443,804

(22) Filed: Nov. 19, 1999

Related U.S. Application Data

(60) Provisional application No. 60/118,591, filed on Feb. 4, 1999.

(51) Int. Cl.[7] ..... F21S 13/12
(52) U.S. Cl. ..... 362/414; 362/276; 362/802
(58) Field of Search ..... 362/802, 276, 362/410, 431, 411, 414, 21; 315/119, 109

(56) References Cited

U.S. PATENT DOCUMENTS

| | | | |
|---|---|---|---|
| D. 350,213 | 8/1994 | Druffel et al. . | |
| D. 368,548 | 4/1996 | Lee . | |
| 1,349,392 | 8/1920 | Tillson | 362/377 |
| 1,670,566 | 5/1928 | Brown | 362/378 |
| 1,830,578 | 11/1931 | Vaughan | 361/105 |
| 3,033,982 | 5/1962 | Burns | 362/376 |
| 3,162,377 | 12/1964 | Ozeki | 362/320 |

(List continued on next page.)

FOREIGN PATENT DOCUMENTS

| | | |
|---|---|---|
| 603893 | 9/1934 | (DE) . |
| 1525219 | 4/1967 | (FR) . |

OTHER PUBLICATIONS

Underwriters Laboratories, "UL Urges Consumers to Replace 500–Wolf Halogen Bulbs with 300–Watt Halogen Bulbs in Torchiere Lamps," Apr. 2, 1996.

Underwriters Laboratories, "Proposed Requirements and Proposed Effective Date for the Eleventh Edition of the Standard for Portable Electric Lamps," UL 153, Nov. 7, 1997.

U.S. Consumer Product Safety Commission, News from CPSC, Jul. 1996.

Underwriters Laboratories, On the MARK, Sep. 1996.

Underwriters Laboratories, Request for Comments on Proposed Requirements for the Eleventh Edition of the Standard for Portable Electrical Lamps, UL 153, Jun. 14, 1996.

*Primary Examiner*—Sandra O'Shea
*Assistant Examiner*—Hargobind S. Sawhney
(74) *Attorney, Agent, or Firm*—Hoffmann & Baron, LLP; Francis E. Marino

(57) ABSTRACT

A lamp including a base for supporting the lamp on a surface, an upwardly directed shade assembly having a top opening to permit light and heat to be directed outwardly therefrom and a stem extending between and connecting the base to the shade assembly. A light socket is provided within the shade assembly and an electrical circuit provides power to the light socket. The shade assembly includes at least a lower shade portion and an upper shade portion. The upper and lower shade portions forming an interface therebetween. The upper shade portion is removably attachable from the lower shade portion for purposes of packaging. The shade assembly opening is also provided with a protective guard extending substantially across the opening. The electrical circuit includes a safety interface device positioned at the interface of the lower shade portion or the upper shade portion such that power to the light socket is terminated unless the upper shade portion is properly affixed to the lower shade portion. In preferred embodiments, the safety interface device is either a switch device or an electrical connector device. Accordingly, the lamp cannot be operated unless properly assembled so that a desired distance is maintained between the heat source and the protective guard on which combustibles may contact.

33 Claims, 16 Drawing Sheets

U.S. PATENT DOCUMENTS

| | | | |
|---|---|---|---|
| 4,450,512 | 5/1984 | Kristofek | 362/276 |
| 4,635,172 | 1/1987 | Steinke | 362/276 |
| 4,685,037 | 8/1987 | Akiyama et al. | 362/276 |
| 4,694,223 | 9/1987 | Campolo | 315/118 |
| 4,740,861 | 4/1988 | Droho et al. | 362/105 |
| 4,751,623 | 6/1988 | Gaines et al. | 362/276 |
| 4,751,624 | 6/1988 | Russo et al. | 362/276 |
| 4,754,377 | 6/1988 | Wenman | 362/148 |
| 4,835,667 | 5/1989 | Wolfe | 362/276 |
| 4,930,054 | 5/1990 | Krebs | 362/149 |
| 4,980,809 | 12/1990 | Baldwin et al. | 362/375 |
| 5,023,744 | 6/1991 | Hofsass | 361/26 |
| 5,101,333 | 3/1992 | Glassford | 362/413 |
| 5,157,579 | 10/1992 | Brenner et al. | 361/103 |
| 5,165,785 | 11/1992 | Doong | 362/295 |
| 5,177,658 | 1/1993 | Brenner et al. | 361/103 |
| 5,221,141 | 6/1993 | Swanson | 362/250 |
| 5,321,576 | 6/1994 | Brenner et al. . | |
| 5,528,448 | 6/1996 | Brenner et al. | 361/103 |
| 5,718,506 | 2/1998 | Yeh | 362/344 |
| 5,720,549 | 2/1998 | Lavy | 362/378 |
| 5,725,303 | 3/1998 | Lin | 362/376 |
| 5,789,869 | 8/1998 | Lo et al. | 315/159 |
| 5,800,052 * | 9/1998 | Yeh | 362/376 |
| 5,801,490 | 9/1998 | Fai | 315/118 |
| 5,863,111 | 1/1999 | Turner et al. | 362/410 |
| 5,902,037 | 5/1999 | Turner et al. | 362/316 |
| 5,997,160 | 12/1999 | Swanson | 362/376 |
| 6,133,695 * | 10/2000 | Caya | 315/119 |

* cited by examiner

LAMP WITH SAFETY FEATURES

This application claims the benefit of Provisional No. 60/118,591 filed Feb. 4, 1999.

FIELD OF THE INVENTION

The present invention relates to a lamp generally, and more particularly to an improved torchiere-style lamp having safety features to prevent risk of fire and injury to persons.

DESCRIPTION OF THE PRIOR ART

Many improvements have been made to enhance the safety of halogen lamps and particularly halogen torchiere-style floor lamps. For example, various different types of guards which extend over the halogen bulb to prevent flammable material from coming in close contact therewith are known and described in several U.S. patents, including commonly owned U.S. Pat. No. 5,863,111. Also disclosed in the '111 patent is the use of a thermostatic switch positioned within the lamp shade which terminates power to the bulb should a predetermined temperature be reached. In this way, fires can be avoided should a flammable material get draped across the shade opening preventing heat generated by the halogen bulb from escaping the lamp shade.

Another prior art patent describing a fire-safe halogen torchiere lamp is U.S. Pat. No. 5,801,490. The '490 patent discloses use of a shielded thermostatic switch within the lamp having a function similar to that described in the '111 patent. As illustrated in FIG. 2 of the '490 patent, a prior art halogen torchiere lamp includes a domed or convex wire guard extending over the lampshade opening to keep combustible materials a safe distance from the heat source, i.e., the halogen bulb. Such a convex shaped grill makes the lamp less appealing by making the grill visible.

Underwriters Laboratory (U.L.) has been instrumental in making halogen torchiere-style floor lamps safer to use. U.L. has revised its testing parameters several times to ensure that the lamps will operate safely in a consumer's home. The latest suggested revision to halogen torchiere-style lamp design, U.L. 153, the disclosure of which is incorporated herein by reference, proposes several changes including requiring the halogen bulb be a minimum of 3 inches (76 mm) from a midpoint on the length of the bulb, measured from the top of the bulb containment barrier to the wire guard which extends across the shade opening that combustibles are able to contact. Furthermore, the distance from the ends of the lamp containment barrier to any point on the wire guard that combustibles are able to contact shall be a minimum 2⅜ inches (60 mm). Yet another proposed requirement to gain U.L. approval will be the installation of a tip-over switch which would de-energize the unit when tipped beyond the angle that the unit would right itself. Accordingly, the present invention is directed to providing improved safety features for the halogen torchiere-style lamps in an effort to reduce the risk of fire and injury to persons without degrading either the appearance of the lamp or the light cast by the lamp.

OBJECTS OF THE INVENTION

It is an object of the present invention to provide a torchiere-style floor lamp which meets or exceeds all proposed U.L. requirements.

It is another object of the present invention to provide a torchiere-style floor lamp in which a wire guard extends substantially across the entire shade opening.

It is a further object of the present invention to provide a torchiere-style floor lamp having a substantially flat wire guard with relatively small openings hingedly affixed to the shade opening.

It is still a further object of the present invention to provide a torchiere-style floor lamp which includes a safety thermostat and/or a tip-over switch to terminate power to the unit should an unsafe condition exist.

It is yet a further object of the present invention to provide a torchiere-style floor lamp design in which the distance from a center point of the top surface of the halogen bulb containment barrier is at least three (3) inches (76 mm) to any point on the protective guard which extends across the opening of the lamp shade that combustibles are able to contact.

It is still a further object of the present invention to provide a torchiere-style floor lamp design in which the distance from an end of a lamp containment barrier to any point on the protective guard that combustibles are able to contact is at least 2⅜ inches (60 mm).

It is yet another object of the present invention to provide a torchiere-style floor lamp having a shade assembly including an upper shade portion and a lower shade portion and further including a safety switch to terminate power to the unit if the upper and lower shade portions are not properly assembled.

It is still a further object of the present invention to provide a torchiere-style floor lamp which is easy to assemble without the use of tools.

It is another object of the present invention to provide a torchiere-style floor lamp design having a required minimum distance between the bulb containment barrier and any point on the wire guard that combustibles are able to contact and substantially fit within the packaging (foam insert and box) currently being used with these types of prior art lamps.

SUMMARY OF INVENTION

According to the lamp of the present invention, the lamp includes a base for supporting the lamp on a surface, a shade assembly, and a stem having a first end extending upwardly from the base and a second end attached to the shade assembly. The lamp further includes a light socket positioned within the shade assembly and an electrical circuit for providing power to the light socket. The shade assembly includes a lower shade portion or shade support and an upper shade portion attachable to the shade support and forming an interface therebetween. The lamp is provided with a means for determining whether the upper shade portion is properly positioned on the lower shade portion. The electrical circuit includes means responsive to the determining means for permitting power to flow to the light socket to illuminate the light bulb only when the shade assembly is properly assembled. The determining means and responsive means are preferably in the form of a safety interface device, such as a safety switch device or electrical connector device is provided at the interface of the shade support and the upper shade portion such that upon proper assembly of the shade assembly, power is permitted to flow through the electrical circuit and illuminate the light bulb. In the case of a push-button switch , the actuator of the switch is moved from its normal position to a closed position, i.e., from a normally open circuit to a closed circuit when the shade assembly is properly assembled. The switch device is provided within the electrical circuit such that power to the light socket is terminated or de-energized unless the upper shade portion is properly affixed to the shade support. In other words, power is supplied to illuminate the light bulb only if the shade assembly is properly assembled.

In a preferred embodiment of the present invention, the safety switch is a push-button switch and, more particularly, a pressure-sensitive switch, although any type of switch device may be used. The pressure-sensitive switch requires a predetermined force to be applied to the actuator to effect a change of conductive state of the switch from its normal position i.e., an open circuit to its closed position, i.e., a closed circuit thereby permitting power to flow to the light socket to illuminate a bulb therein.

In an alternative embodiment, the shade assembly interface safety device is a connector having a male connector portion and a female connector portion affixed to the upper and lower shade portions. The connector is preferably a two-prong male plug connector and mating female receptacle such that when the plug connector is inserted into the female receptacle, power is permitted to flow through the connector and illuminate the light bulb. If the shade assembly is disassembled, i.e., the upper and lower shade portions are taken apart, the male plug is an open circuit and the light cannot be operated, thus ensuring that the shade assembly be properly assembled with the male plug and female receptacle connected together prior to operation. Accordingly, the safety features afforded by the two-piece shade assembly are achieved by including the safety feature of the connector.

The lamp shade assembly further includes a protective guard or grille which is mounted across the open ended shade assembly. The wire guard is preferably substantially flat so as not to affect the appearance of the lamp. In order to ensure that the grille does not become detached from the shade assembly, the grille is hingedly affixed to the upper shade portion. Alternatively, the grille may be connected by a chain, fastener, clips or other means of attachment to the shade assembly to prevent the grille from being lost or misplaced and not properly reassembled after cleaning or replacement of the light bulb. In the case of the hinged grille, the grille may be pivoted from an open position to access the interior of the shade to a closed position to ensure that flammable objects are maintained a safe distance from the heat source i.e., the bulb.

Positioned within the lamp shade and extending substantially across the light socket is a containment barrier glass shield. In order the ensure safe operation of the lamp, the distance from the center point of the light bulb measured from the top of the glass shield to the closest point on the grille is at least 3 inches. Furthermore, a minimum distance measured from an end of the glass shield to any point on the grille is at least 2⅜ inches.

To further enhance the safety of the lamp, the electrical circuit further includes a heat-sensitive switch such as a thermostat for sensing ambient air temperature within the shade assembly. The thermostat terminates power to the light socket in response to sensed ambient air temperature reaching a predetermined value. Accordingly, should an object become draped over the open end of the shade to create a fire hazard, the thermostat, upon reaching a predetermined temperature, will terminate power to the light until the light is shut off and/or unplugged. The electrical circuit further includes a tip-over or tilt switch for sensing an angle of tilt of the lamp with respect to a substantially horizontal support surface. The tilt switch terminates power to the light socket in response to the lamp being tilted beyond a predetermined angle with respect to the support surface.

Although the invention including a multiple-piece shade assembly with a safety device preventing operation unless the shade assembly is properly assembled could be applied to an incandescent, fluorescent, or any other type of lamp, in a most preferred embodiment, the lamp is a halogen torchiere-style floor lamp. Accordingly, the stem is a substantially elongated pole which extends between the base and the lower portion of the shade assembly. The light socket includes an elongated halogen bulb mounted therein and a containment barrier glass shield extending substantially across the light socket to prevent injury should the halogen bulb rupture. The halogen torchiere-style floor lamp includes the same two-piece shade assembly which includes a lower shade support portion and an upper shade portion and a safety switch mounted therebetween to prevent the light from being operated unless the shade assembly is properly assembled.

Although the halogen torchiere-style floor lamp of the present invention meets and/or exceeds newly proposed U.L. requirements, the disassembled lamp is arranged to fit within a package similar in size to prior art lamps. More specifically, the disassembled halogen torchiere-style floor lamp of the present invention can be arranged to fit within a package having a volume less than one cubic foot. Furthermore, the disassembled lamp may be arranged to fit within a package having a width less than six inches. In order to fit within the packaging less than one cubic foot, the lower shade assembly is able to be positioned within the upper shade assembly for packaging purposes. The safety switch positioned between the upper and lower shade portions ensures that the light will not be operated unless the shade assembly is properly assembled, and thus meeting or exceeding the proposed U.L. relative distance requirements between the containment barrier glass shield and the wire guard extending across the lamp shade assembly opening. Accordingly, both packaging and shipping costs may be reduced due to the reduced size of the packaging.

In order to provide an even safer operating lamp, the electrical circuit of the halogen torchiere-style floor lamp includes a thermostatic switch to terminate power to the light socket should an overheat condition be sensed and a tip-over switch to terminate power to the light socket should the lamp be accidentally knocked over.

A preferred form of the lamp, as well as other embodiments, objects, features and advantages of this invention will be apparent from the following detailed description of illustrative embodiments thereof, which is to be read in connection with the accompanying drawings.

DETAILED DESCRIPTION OF THE PREFERRED EMBODIMENT

Figure 1:
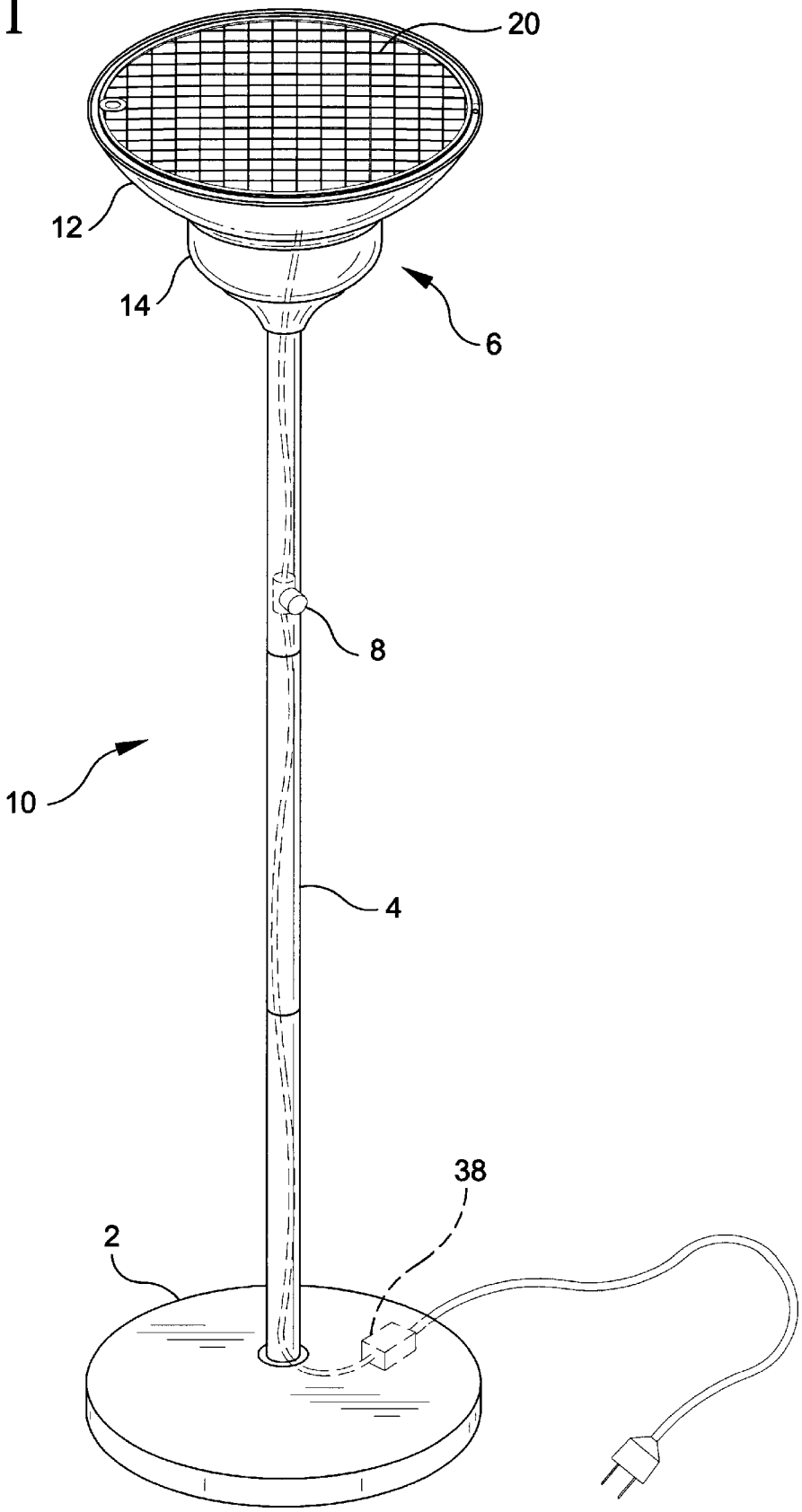
FIG. 1 is a top perspective view of a torchiere-style floor lamp formed in accordance with the present invention.

As illustrated in FIG. 1, a torchiere-style floor lamp 10 formed in accordance with the present invention includes a lamp base 2 for supporting the lamp on a floor or the like, an elongated stem 4 having a first end attached to a central portion of the base 2 and a second end coupled to a shade assembly 6. The stem 4 is hollow and includes a rotary dimmer switch 8 for controlling the on/off function of the power supply to the lamp. The dimmer switch 8 controls the intensity of the lamp in the "on" position and may also include a light sensitive element for functioning as a "night light" by sensing ambient lighting conditions. Such a dimmer switch 8 is described in commonly owned U.S. Pat. No. 5,789,869, the disclosure of which is incorporated herein by reference.

Figure 2:
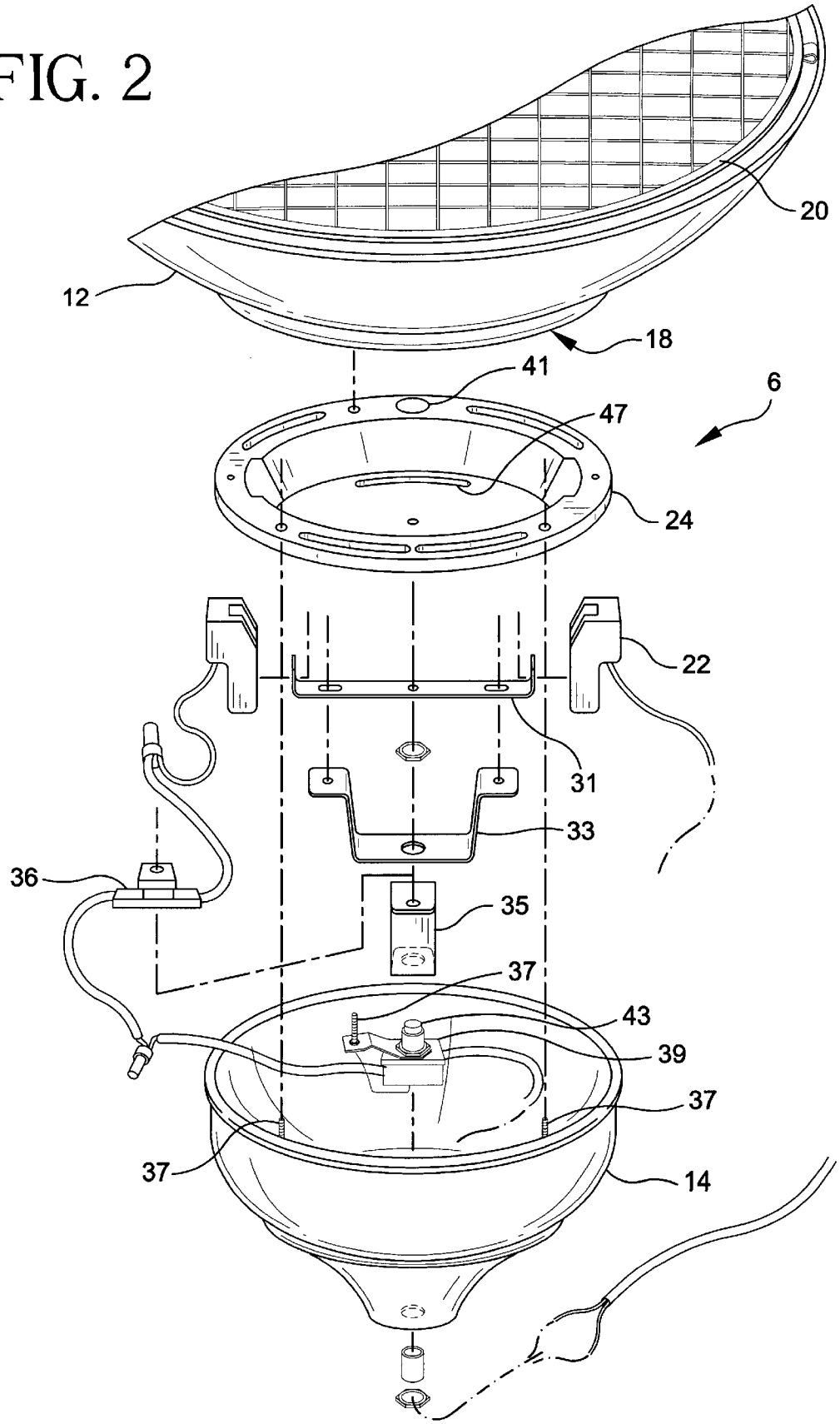
FIG. 2 is an exploded view of the lamp shade assembly of the torchiere-style floor lamp illustrated in FIG. 1.
Figure 3:
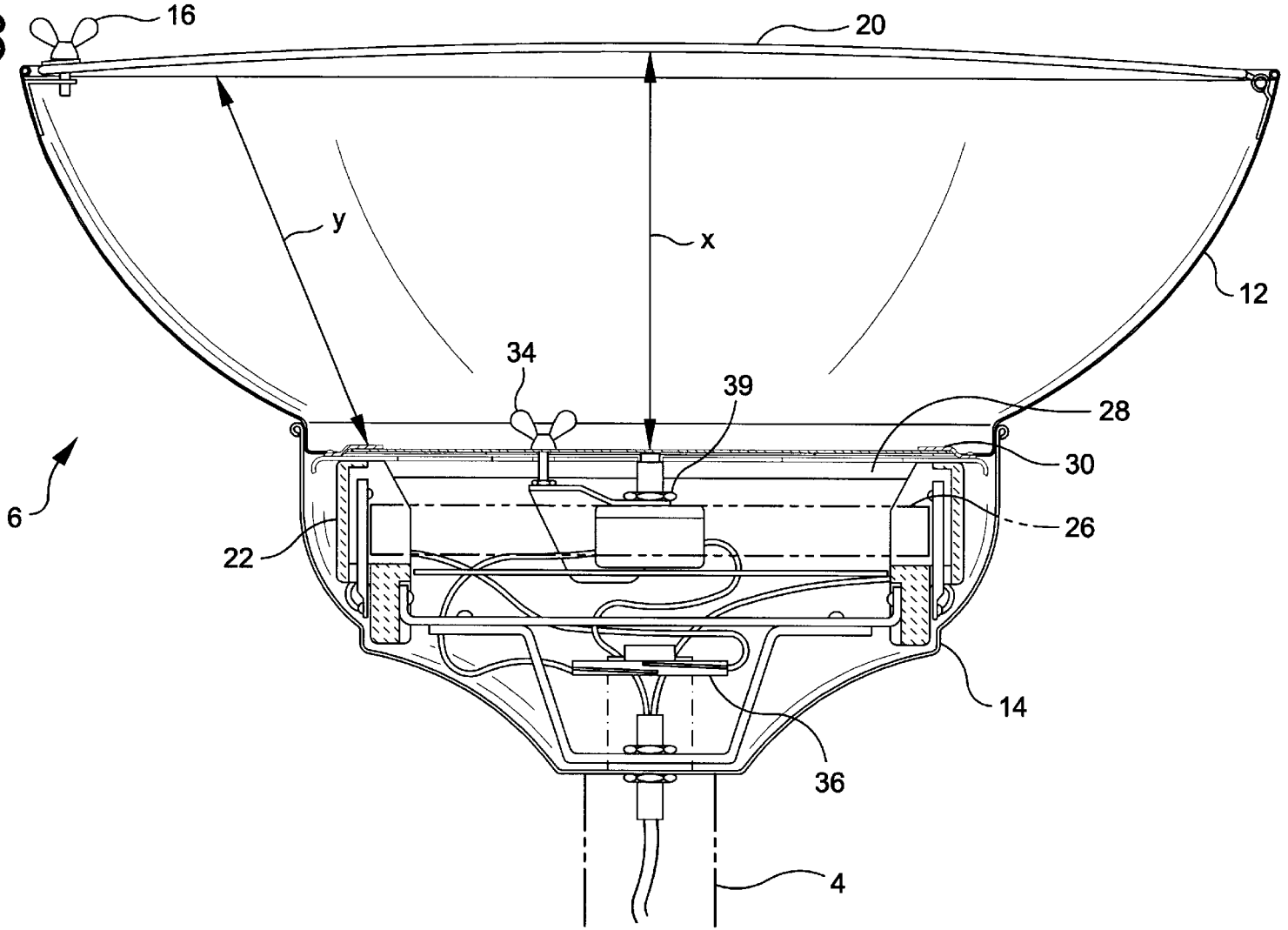
FIG. 3 is a cross-sectional view of the lamp shade assembly of the torchiere-style floor lamp of the present invention.
Figure 4A:
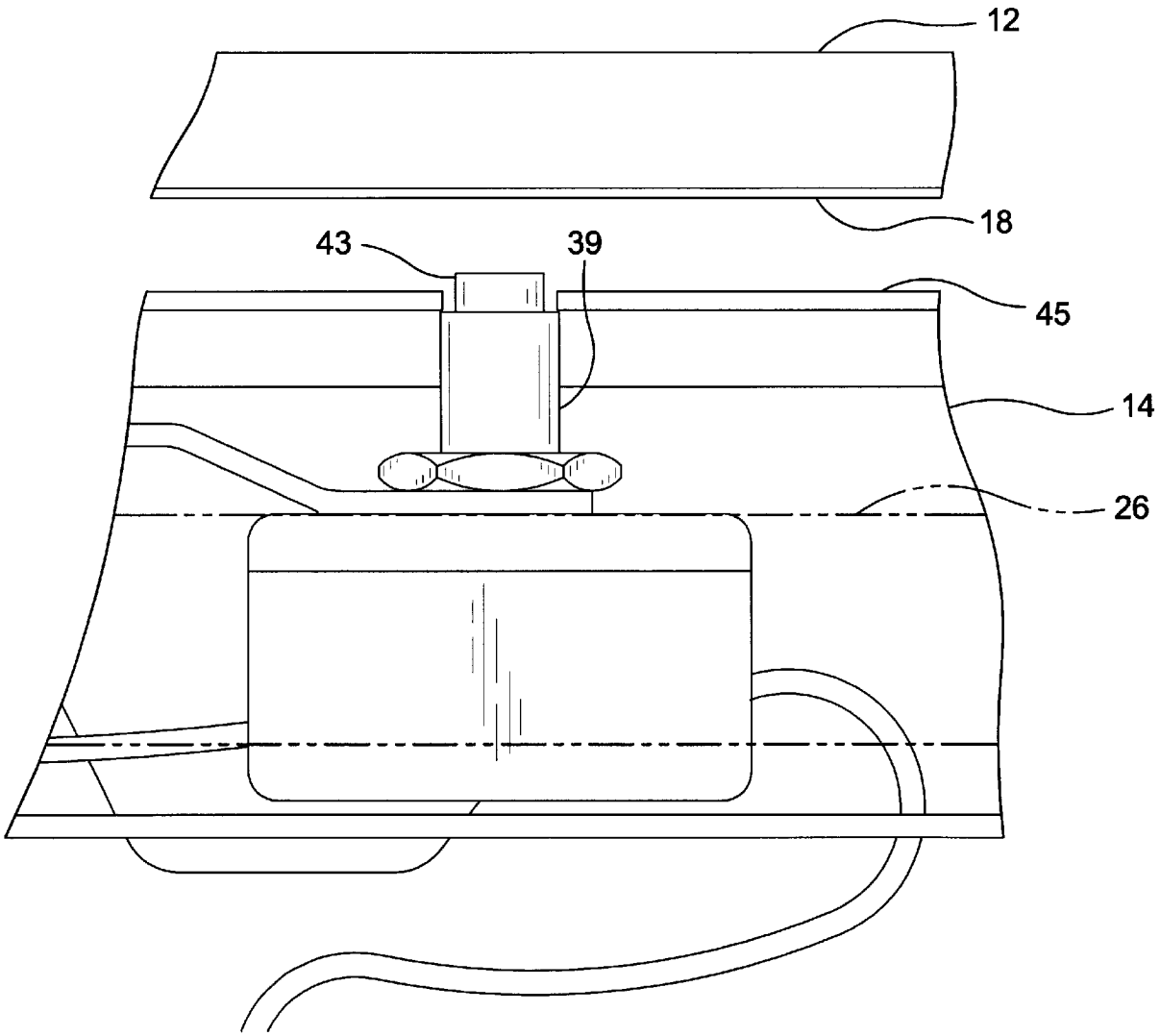
FIG. 4A is an enlarged partial view illustrating the safety-switch in its normal position and the upper shade disassembled from the lower shade support.
Figure 6:
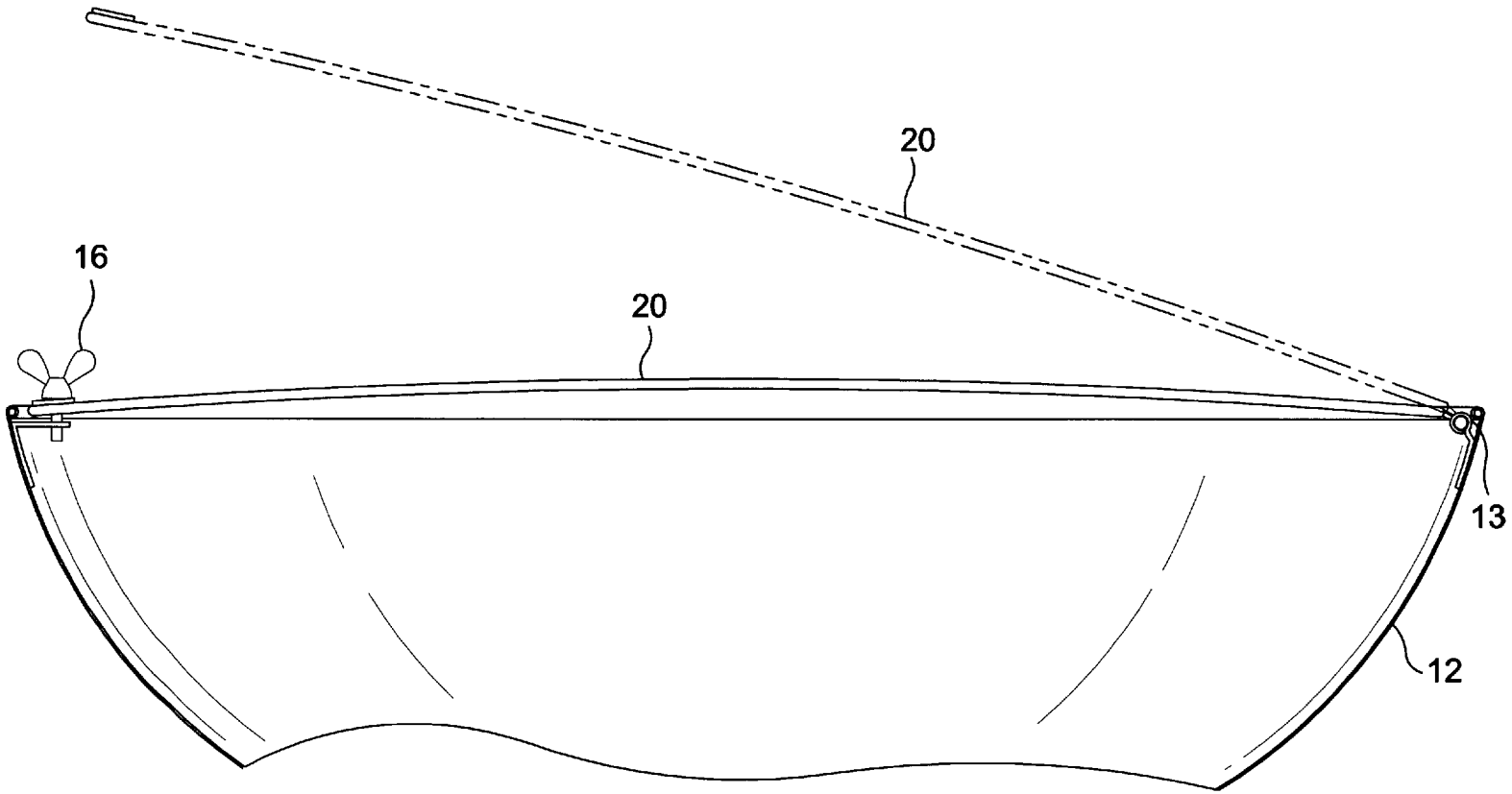
FIG. 6 is a partial side view of the upper shade portion with the wire guard illustrated in the open and closed position.

As shown in. FIGS. 1 and 2, the shade assembly 6 of the present invention has been modified from known shades used on these types of lamps. More specifically, the lamp shade assembly 6 includes an upper shade portion 12 and lower shade portion or shade support 14. The upper shade portion 12 is preferably a concave-shaped structure having an open upper end for directing light and heat upwards and out of the shade assembly. The lower end of the upper shade portion also includes an opening surrounded by lip 18. (FIG. 4A). The upper shade portion 12 also further includes a guard 20 positioned across the open upper end 16 to prevent objects from falling into the shade assembly and possibly coming in contact with the bulb or creating a fire hazard by preventing heat from escaping the shade assembly 6. As illustrated in FIGS. 2, 3 and 6, the guard 20 comprises a substantially flat wire mesh which is hinged 13 on one side of the upper shade portion to allow access to change the bulb and to clean the inside area of the shade assembly. Upon pivoting the guard 20 down to its closed position, the guard 20 is held securely to the upper shade portion by use of a fastener 16, such as a screw or wing nut.

The lower shade portion 14 includes a bottom end which is detachably coupled to the second end of the stem 4. The lower shade portion 14 houses the lamp socket 22, the reflector 24, the halogen bulb 26, and a semi-circular glass bulb containment barrier or shield 28 which is held in place by clamps 30. Also shown in FIGS. 2 and 3 are the electrical wires 32 which are electrically connected to the lamp socket 22. A series of brackets 31, 33, 35 support the light socket within the lower shade portion 14 as well as supporting the thermostatic switch 36. This configuration is different from existing torchiere-style floor lamps since the light socket and reflector are mounted in the lower shade portion rather than in a unitary shade as illustrated in commonly owned U.S. Pat. No. 5,863,111. The upper end of the lower shade portion 14 is open and includes either a rim, recess, threaded bolts affixed to the interior of the lower shade portion or other means for attachment to the upper shade portion 12 to form the shade assembly 6. As illustrated in FIGS. 2 and 3, the upper shade portion and lower shade portion are fixedly coupled together via the use of threaded bolts 37 and wing nuts 34. However, it is envisioned that any means may be used to couple the upper and lower shade portions to form the shade assembly 6 including a snap-fit connection, a threaded connection whereby the upper shade portion may be screwed onto the lower shade portion, or a twist-lock configuration as illustrated in FIG. 8.

Figure 8:
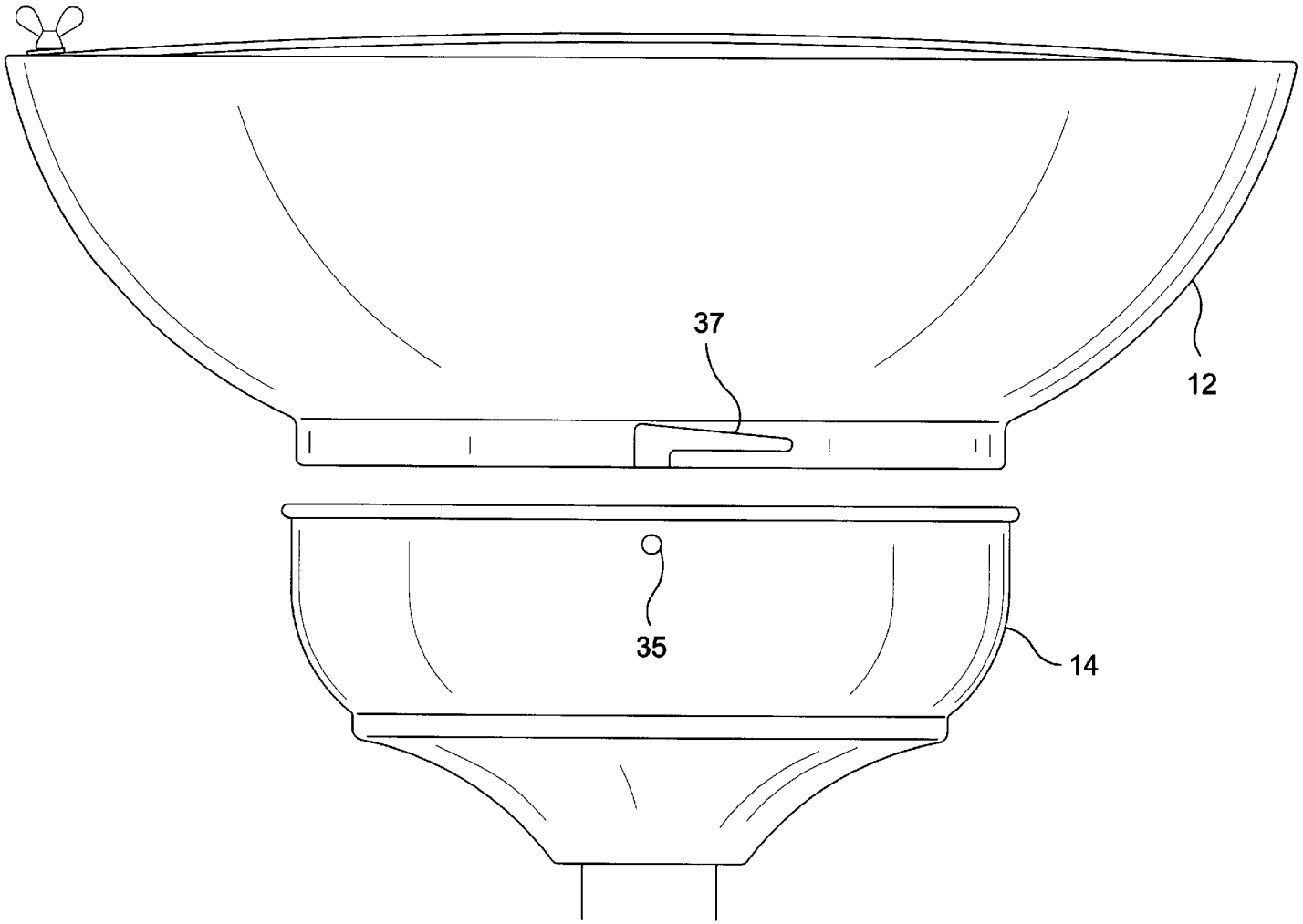
FIG. 8 is an alternative shade assembly illustrating an alternative coupling mechanism for mounting the upper shade portion to the lower shade support.

Referring to FIG. 8, the twist-lock configuration includes at least one pin 35 on either the upper or lower shade portion and at least one receiving groove 37 on the opposite shade portion from the pin for mating cooperation upon a twisting motion of the shade portions relative to each other.

In order to ensure the lamp shade assembly 6 has been properly assembled prior to operation, the torchiere-style lamp of the present invention includes a means for determining whether the shade assembly is properly assembled. The electrical circuit of the lamp includes means responsive to the determining means such that power is provided to the light socket only when the shade assembly is properly assembled. The determining means and responsive means may include a safety interface device, e.g., either a safety switch device 39 or safety connector 47 or other such device, which prevents operation of the lamp unless the upper and lower shade portions 12, 14, respectfully, of the shade assembly 6 are properly affixed. Thus, the lamp of the present invention cannot be operated unless the upper shade portion 12 including the wire guard 20 is properly positioned and affixed to the lower shade portion to reap the benefit of all the safety features of the present invention.

The safety switch 39 is preferably a pressure-sensitive single pole, single throw, normally open circuit, push-button switch such as a McGill 100 Series Push-Button Switch, sold by McGill Electric Switch Product Group. The pressure-sensitive switch preferably requires a minimum pressure or force to be applied to the switch actuator 43 in order to effect a change of conductive state of the switch, e.g., from a normally open circuit to a closed circuit. For example, the operating pressure of the switch may be a minimum of 2 lbs. Use of a pressure-sensitive switch ensures that the lamp cannot be operated unless the shade assembly 6 is properly assembled and the fastening means securely fastened. It is envisioned that many different types of switch devices may be employed to carry out the safety function of the present invention, i.e., ensuring proper assembly of the shade assembly prior to operation. These different types of switch devices include proximity sensors, magnetic switches or any other known switch to those of ordinary skill in the art.

Figure 4B:
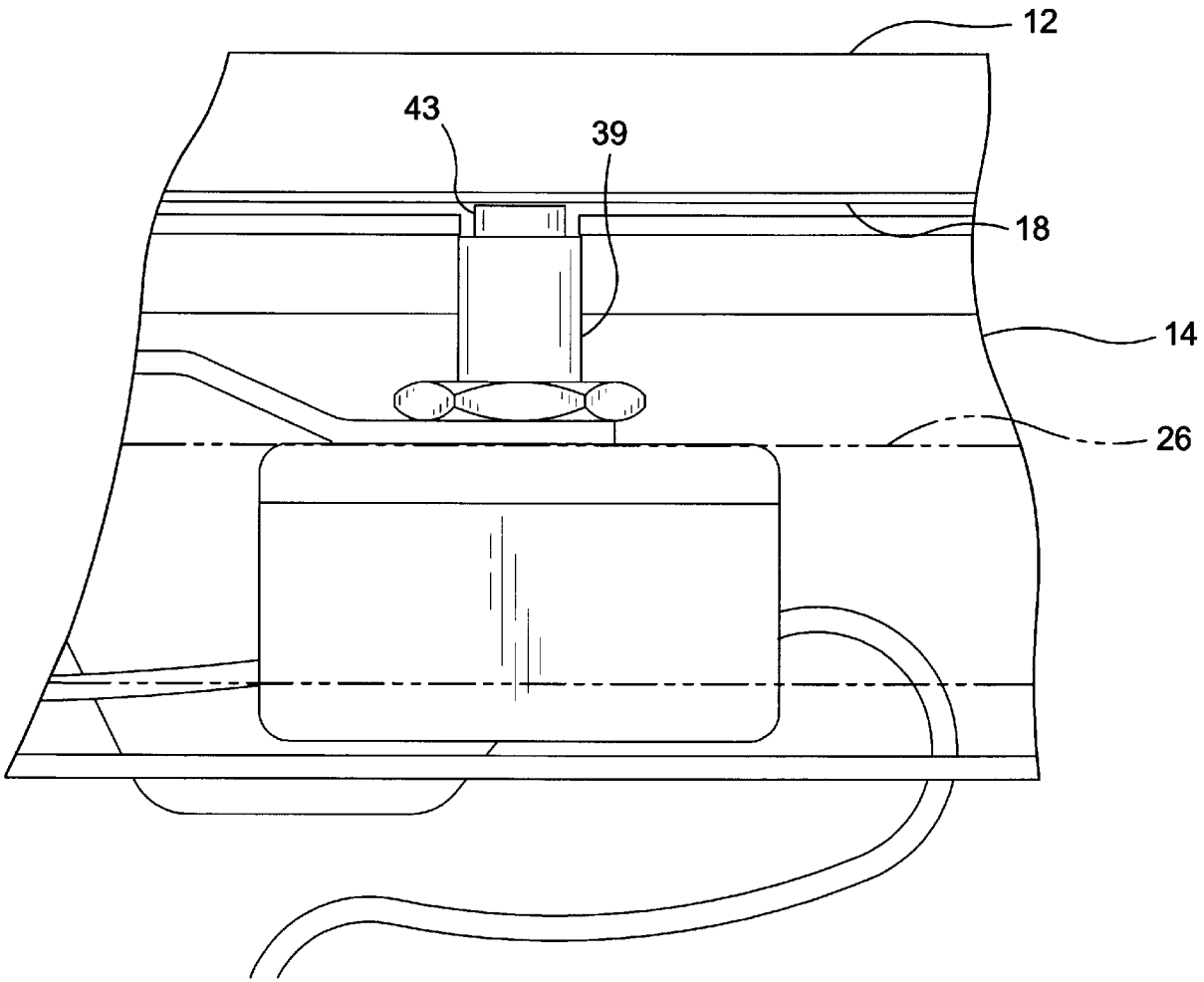
FIG. 4B is an enlarged partial view illustrating the safety-switch in its activated position and the upper shade affixed to the lower shade support in its activated position.

In the preferred embodiment illustrated in FIGS. 2 and 3, the reflector 24 includes an opening 41 therethrough for accommodating the actuator of the switch 39. FIG. 4A is an enlarged partial view of the shade assembly 6 wherein the upper shade portion 12 is illustrated disassembled from the lower shade support 14. The actuator 43 of the safety switch 39 extends above an upper edge 45 of the lower shade support 14. The switch 39 is mounted to an inside side portion of the lower shade support 14 and, upon mounting the upper shade portion to the lower shade portion, the upper shade portion engages the switch actuator 43 as illustrated in FIG. 4B. More specifically, a lip portion 18 or lower edge of the upper shade portion 12 engages the switch actuator 43. When the upper shade portion 12 is securely affixed to the lower shade portion and the fasteners securely fastened , the conductive state of the switch 39 is changed from an open circuit position to a closed circuit thereby allowing power to be supplied to the light socket to illuminate the bulb. Accordingly, the safety switch 39 ensures that the minimum distance requirements suggested by U.L. from the bulb to the wire guard are met and the lamp will not be operated without the upper shade portion and wire guard to ensure safe operation of the lamp. Without the safety switch, it would be possible for a purchaser to improperly operate the lamp without assembling the shade assembly. The present invention permits the lamp to be disassembled for packaging purposes, yet provides for enhanced operating safety by not allowing the light to function unless properly assembled.

Figure 5A:
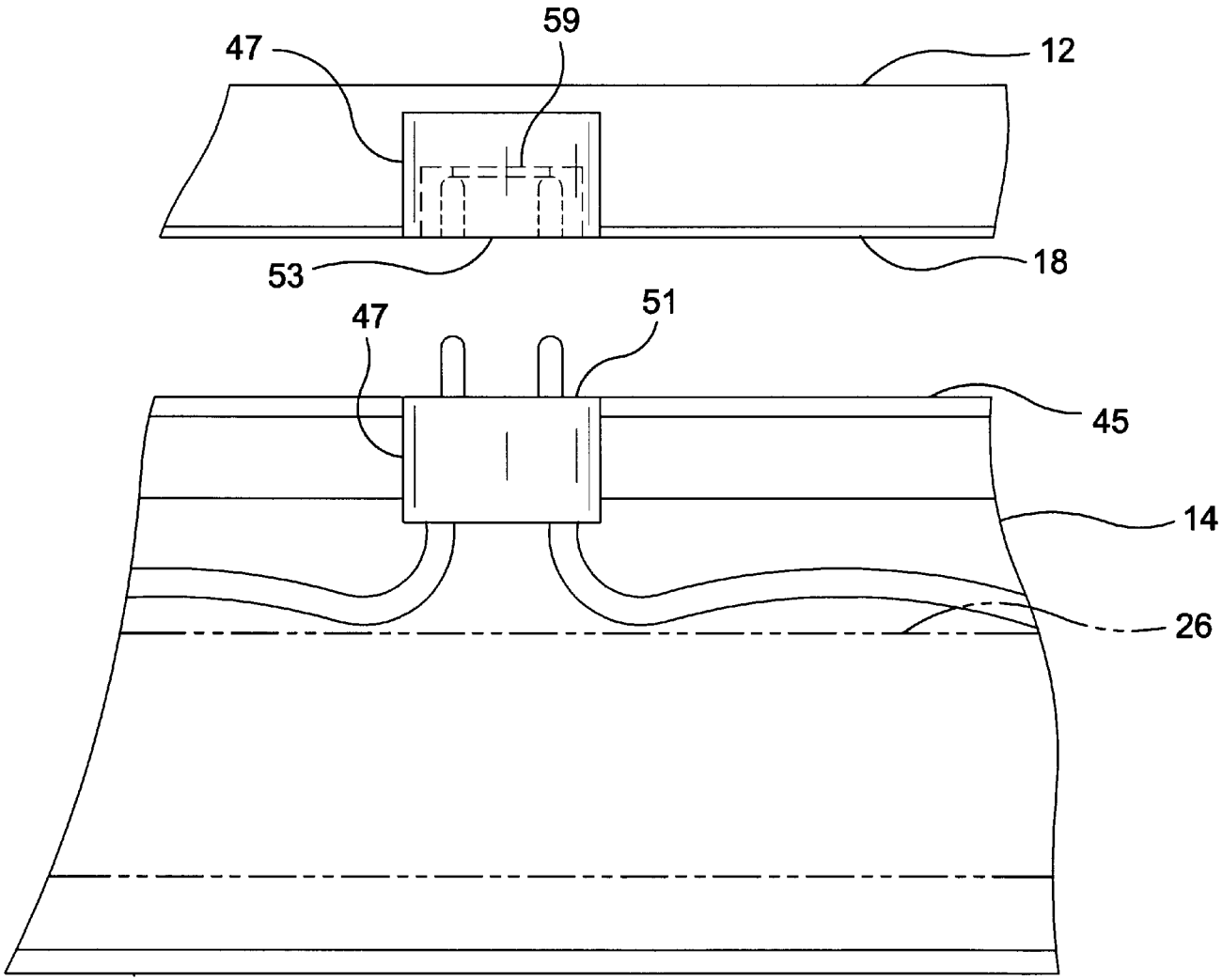
FIG. 5A is an enlarged partial view illustrating the safety connection and upper and lower shade portions shown disassembled.
Figure 5B:
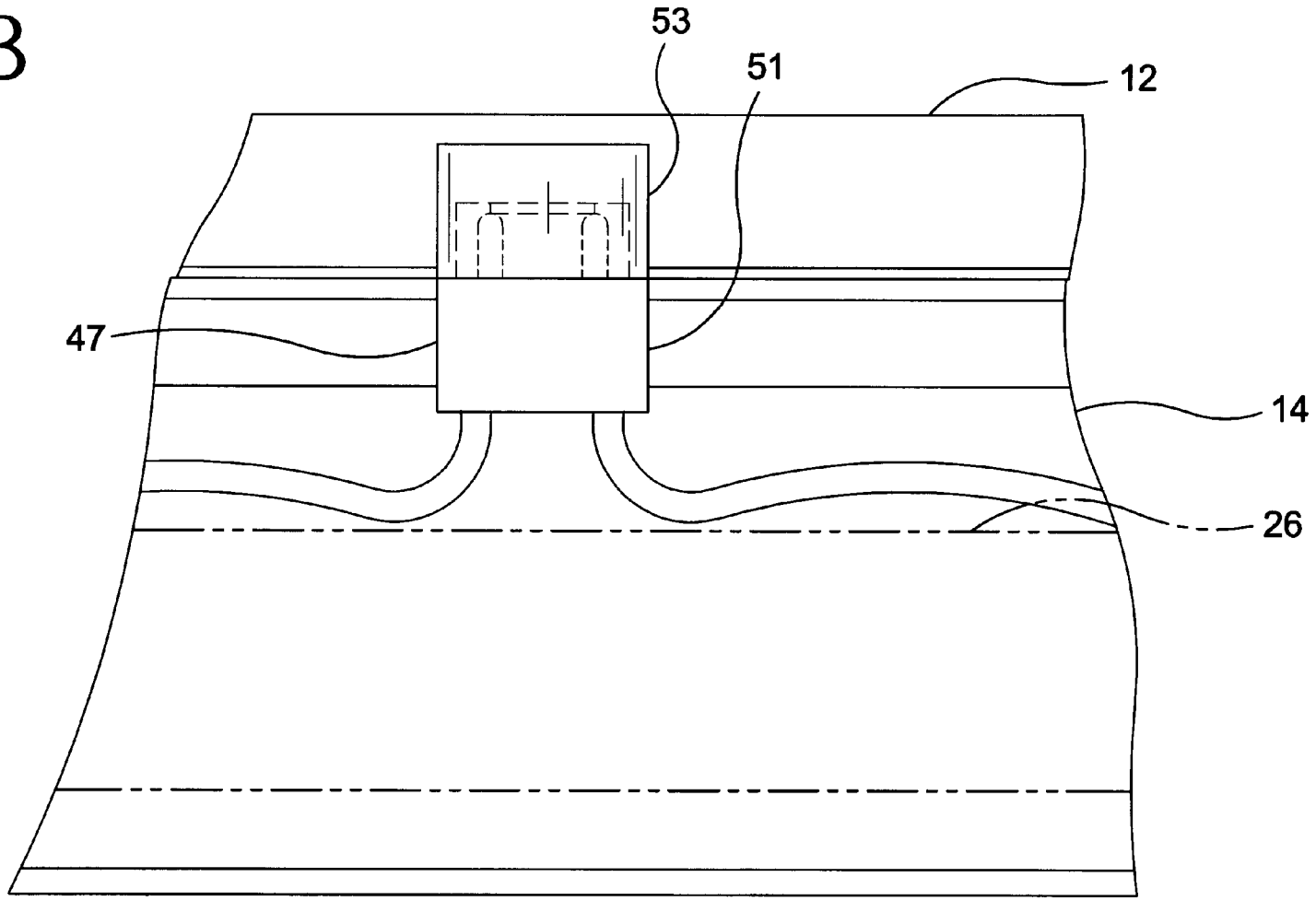
FIG. 5B is an enlarged partial view illustrating the safety connector shown in its assembled conductive state.

Referring to FIG. 5A and 5B, an alternative embodiment is illustrated in which the safety interface device comprises a safety connector device 47. The connector device 47 comprises a male plug connector portion 51 and a female receptacle portion 53. The connector device portions are attached to the upper and lower shade portions of the shade assembly. For example, the male plug 51 may be mounted to the lower shade support 14 such that the prongs 55 of the plug extend upwardly beyond an upper edge of the lower shade support. The female receptacle portion 53 may be mounted to the upper shade portion 12 such that upon assembly of the upper and lower shade portions and alignment of the plug 51 and receptacle, the connector is assembled. Upon assembly of the connector device 47 current is permitted to flow through the prongs of the plug 51 and mating conductor 59 in the receptacle to allow the light to be operated. If the shade assembly is not properly assembled such that the safety connector device is assembled, no power is permitted to flow to the light socket and the light cannot be operated. Accordingly, the safety connector device 47 ensures that the shade assembly be properly assembled prior to operation of the lamp. It is also envisioned that other types of connectors or simply a conductor mounted within the upper shade portion which completes an otherwise open circuit positioned within the lower shade support may be used to ensure proper assembly of the shade assembly. Such other safety interface devices are believed to be within the scope of the invention.

Referring to FIGS. 2 and 3, each of the components of the lamp which were previously contained in the lower portion of a prior art unitary shade are now positioned within the lower shade portion 14 of the design of the present invention. Thus, a greater distance is achieved between the halogen bulb 26 and the bulb containment barrier glass shield 28 and the top of the shade assembly 6 including the wire guard 20 on which combustibles are able to contact. With reference to FIG. 3, the distance "X" between the halogen bulb containment barrier 28 center point to any point on the guard 20 that combustibles are able to contact is a minimum of 3 inches (76 mm). The distance "Y" from the ends of the lamp containment barrier 28 to any point on the guard 20 that combustibles are able to contact is a minimum of 2⅜ inches (60 mm.). Thus, the heat source, i.e. the halogen bulb is maintained a safe distance from any foreign objects and/or combustibles which may be placed upon or over the guard 20 positioned across the shade assembly opening to prevent a fire hazard. The present invention provides the advantage of being able to use a substantially flat wire guard 20 which does not detract from the appearance of the lamp.

As shown in FIGS. 2 and 3, the torchiere-style floor lamp of the present invention preferably includes a thermostatic switch 36 which senses temperature within the shade assembly 6 and, upon the temperature reaching a predetermined set point, terminates power to the light socket, thereby shutting off the lamp. The thermostatic switch is a normally closed switch which changes to an open circuit upon sensing a predetermined temperature. Such a device and design is disclosed in commonly owned U.S. Pat. No. 5,863,111, the disclosure of which is incorporated herein by reference. In the improved design of the present invention, the thermostatic switch 36 is preferably positioned within the lower shade portion beneath the reflector 24 and aligned with an opening 47 therein, although many locations within the shade assembly will provide satisfactory operation of the thermostatic switch. Accordingly, unsafe conditions, such as combustible material being draped over the lamp, are prevented by turning off the lamp and not permitting the lamp to operate until power to the lamp is terminated and the thermostatic switch is allowed to reset.

The electric circuit of the present invention also preferably includes a tip-over or tilt switch 38 which terminates power to the light socket should the lamp be tipped to a predetermined angle from normal. The tip-over switch senses an angle of tilt of the lamp with respect to a horizontal surface. Upon sensing that the lamp has been tipped a predetermined angle from normal, the switch changes conductive state to an open circuit terminating power to the light socket to prevent a potentially hazardous condition. The tip-over switch 38 is preferably positioned either in the base 2 as shown in FIG. 1 or in the shade assembly 6, and more preferably in the lower shade portion 14 of the shade assembly.

Figure 7:
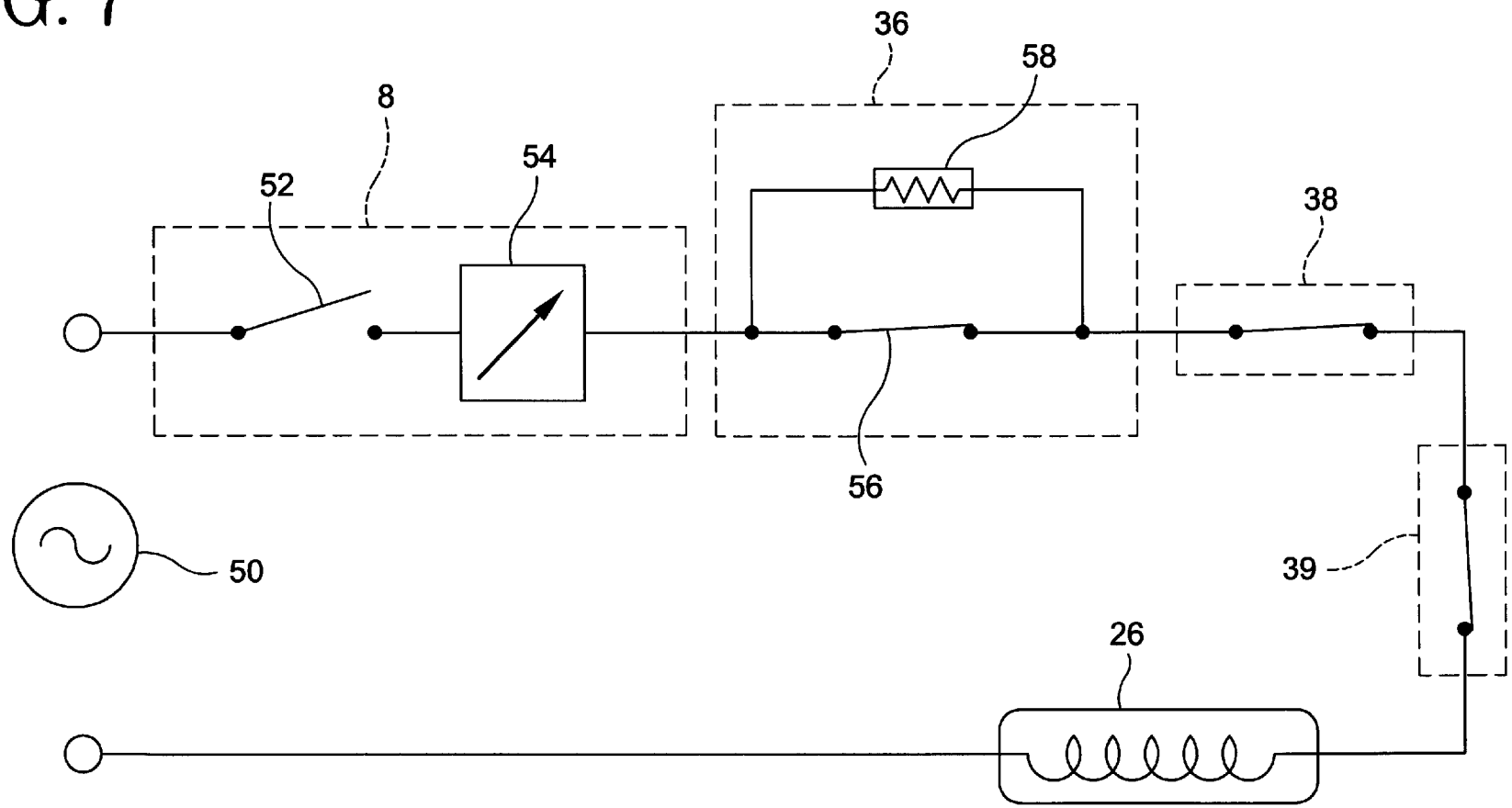
FIG. 7 is a simplified electrical schematic for the electrical circuit of the torchiere-style floor lamp of the present invention.

FIG. 7 is a simplified electrical schematic of the circuit including each of the safety features associated with the present invention. The circuit includes a power source 50 for providing AC power to the lamp. The power source 50 is connected in series with a switch 8 including an on/off switch 52 in combination with a dimmer switch 54. Additionally, a thermostat 36 is connected in series between the switch 8 and the light socket. Preferably, the thermostat 36 includes a bimetallic contact 56 and a parallel connected heating element 58. If the temperature of ambient air surrounding the thermostat reaches a predetermined temperature based upon the rated temperature of the thermostat, the bimetallic contact will change from a short circuit to an open circuit terminating power to the lamp socket and the power supply is then applied across the heating element 58. The heating element is a ceramic element which has been heated by the ambient air and, upon current being applied to the element, generates sufficient heat to maintain the bimetallic contact in an open circuit keeping the lamp off until power to the lamp is terminated either by turning off the switch or unplugging the lamp and allowing the thermostatic switch to cool down and reset.

The electrical circuit further includes a tip-over switch 38 also connected in series between the switch 8 and the light socket. Should the lamp be tipped to a predetermined angle from an upright position, the switch 38 changes to an open circuit terminating power to the lamp until the lamp is again placed in its operating upright position.

Lastly, the electrical circuit includes a safety switch 39, connected in series between the switch 8 and the light socket for sensing whether the lamp shade assembly has been properly assembled. If the upper shade portion 12 is not properly affixed to the lower shade portion 14, the safety switch 39 acts as an open circuit terminating power to the light socket and halogen bulb 26. Only upon proper assembly of the shade assembly will the lamp be able to operate, thus ensuring safe operation.

FIGS. 1 and 2 illustrate the wire guard 20 of the torchiere-style floor lamp formed in accordance with the present invention. The guard 20 extends substantially across the open upper end of the shade assembly. As earlier discussed, the guard 20 helps to prevent objects, such as drapes or other flammable materials from falling into the cavity of the shade assembly. By keeping flammable objects away from the heat source, i.e. halogen bulb, potential fire hazards may be avoided. As shown in FIGS. 1 and 2, the guard 20 comprises a wire mesh design which is substantially flat having relatively small openings, generally about 50 $mm^2$ in area or less to prevent objects from getting into the cavity of the shade assembly. Alternatively, the guard 20 may be formed from heat resistant glass, plastic, and/or heat resistant plastic strings strung like a tennis racquet within a frame. As illustrated in FIG. 6, the guard 20 is hinged 13 on one side of the upper shade portion to allow access to the shade assembly cavity to change the bulb and for purposes of packaging which are discussed below.

The method of assembly and packaging of the torchiere-style floor lamp also forms an important aspect of the invention. Although the torchiere-style floor lamp design has been significantly modified to provide for enhanced safety features, i.e. greater distance between the bulb and a top surface of the shade assembly, a thermostatic switch, a safety switch and a tip-over switch, the packing materials, i.e. the styrofoam insert and outer box, for the lamp remain substantially unchanged from previously designed lamps such as that illustrated in the '111 patent. This is possible by constructing the shade assembly to be disassembled and arranged in a manner similar to that of conventional torchiere-style floor lamp shades.

Figure 9:
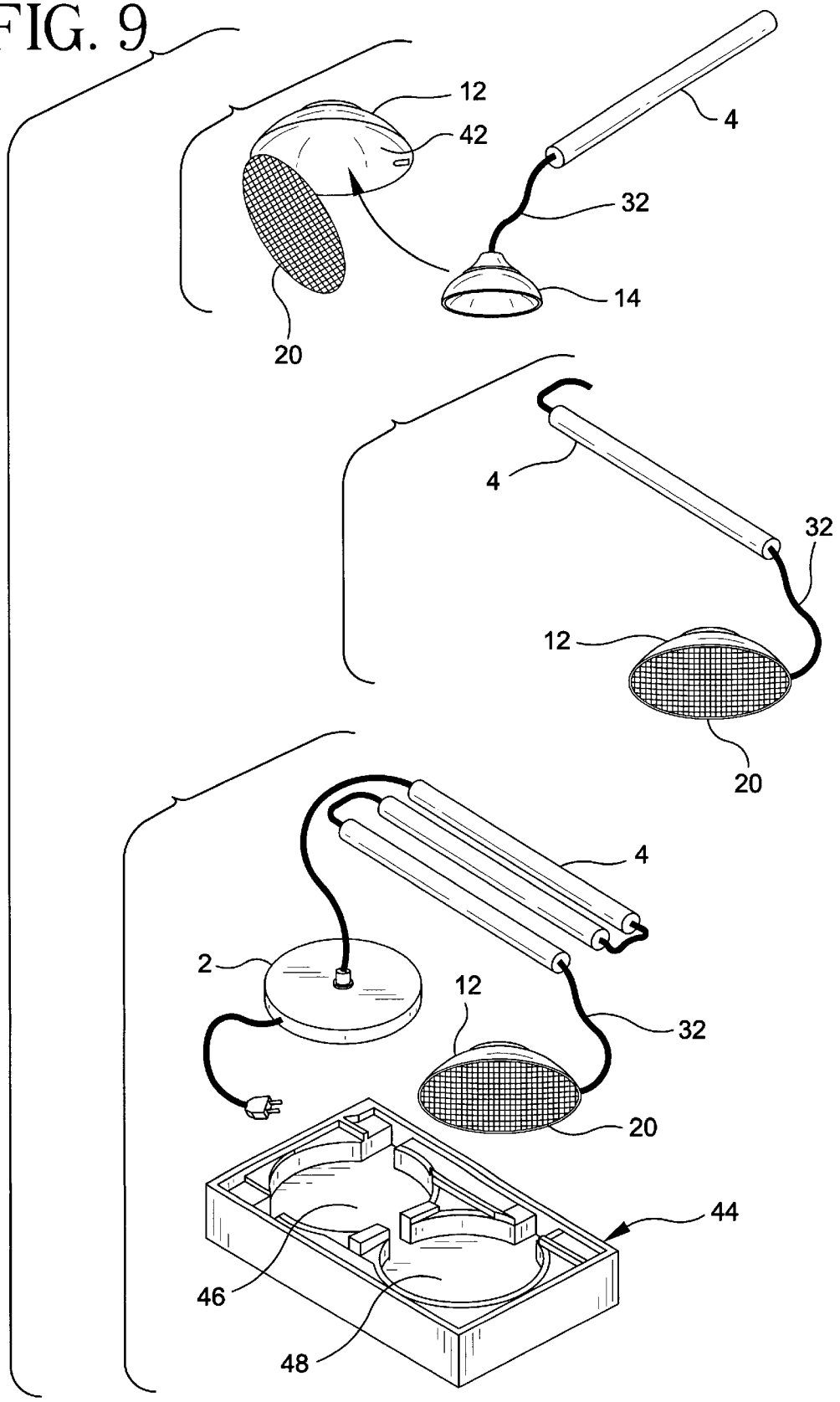
FIG. 9 is a series of drawings illustrating the steps for placement of a disassembled torchiere-style floor lamp of the present invention within the styrofoam product packing.

FIG. 9 illustrates the series of steps for packaging the disassembled component parts of the lamp formed in accordance with the present invention. The upper shade portion 12 is completely detachable from the outer shade portion 14 and the stem 4 is able to be disassembled into at least three portions. The stem 4 is also detachable from the lower shade portion 14. The wires 32 remain connected to the light socket by including enough slack to allow the stem 4 and lower shade portion 14 to be separated for purposes of packaging. Additionally, the opening in the upper end of the upper shade portion is sufficiently sized to allow the lower shade portion 14 to be positioned within the cavity 42 of the upper shade portion 12 upon pivoting the guard 20 to its open position. More specifically, upon disassembly of the upper and lower shade portions, the lower shade portion 14 is placed within the upper shade portion 12 cavity and the guard 20 is again pivoted to its closed position. It should also be noted that the guard 20 being of a substantially flat design aids in allowing the lamp of the present invention to be placed in minimally sized packaging.

Figure 10:
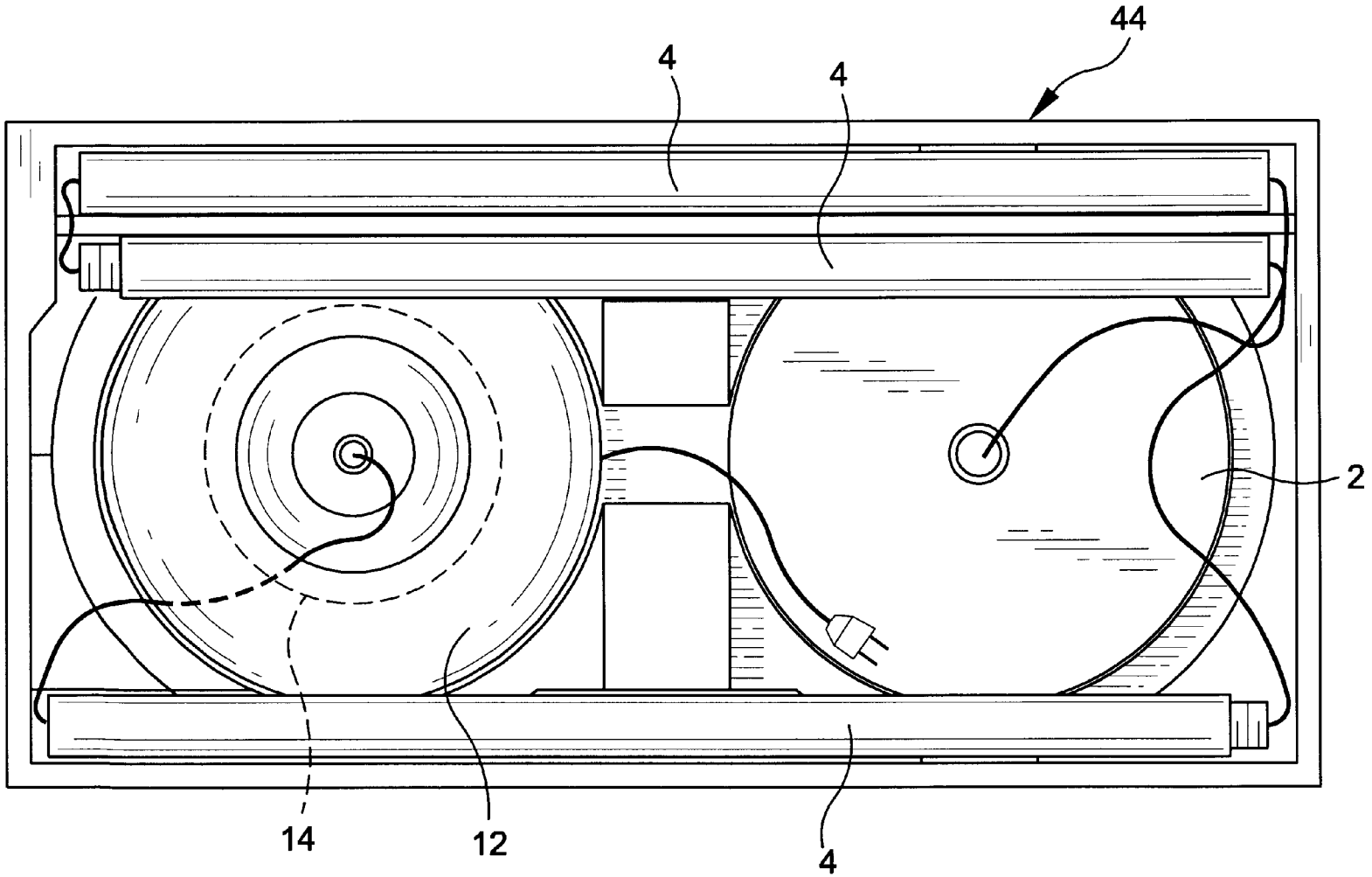
FIG. 10 is a top plan view of a disassembled torchiere-style floor lamp of the present invention shown in the styrofoam bottom portion of the product package.
Figure 11:
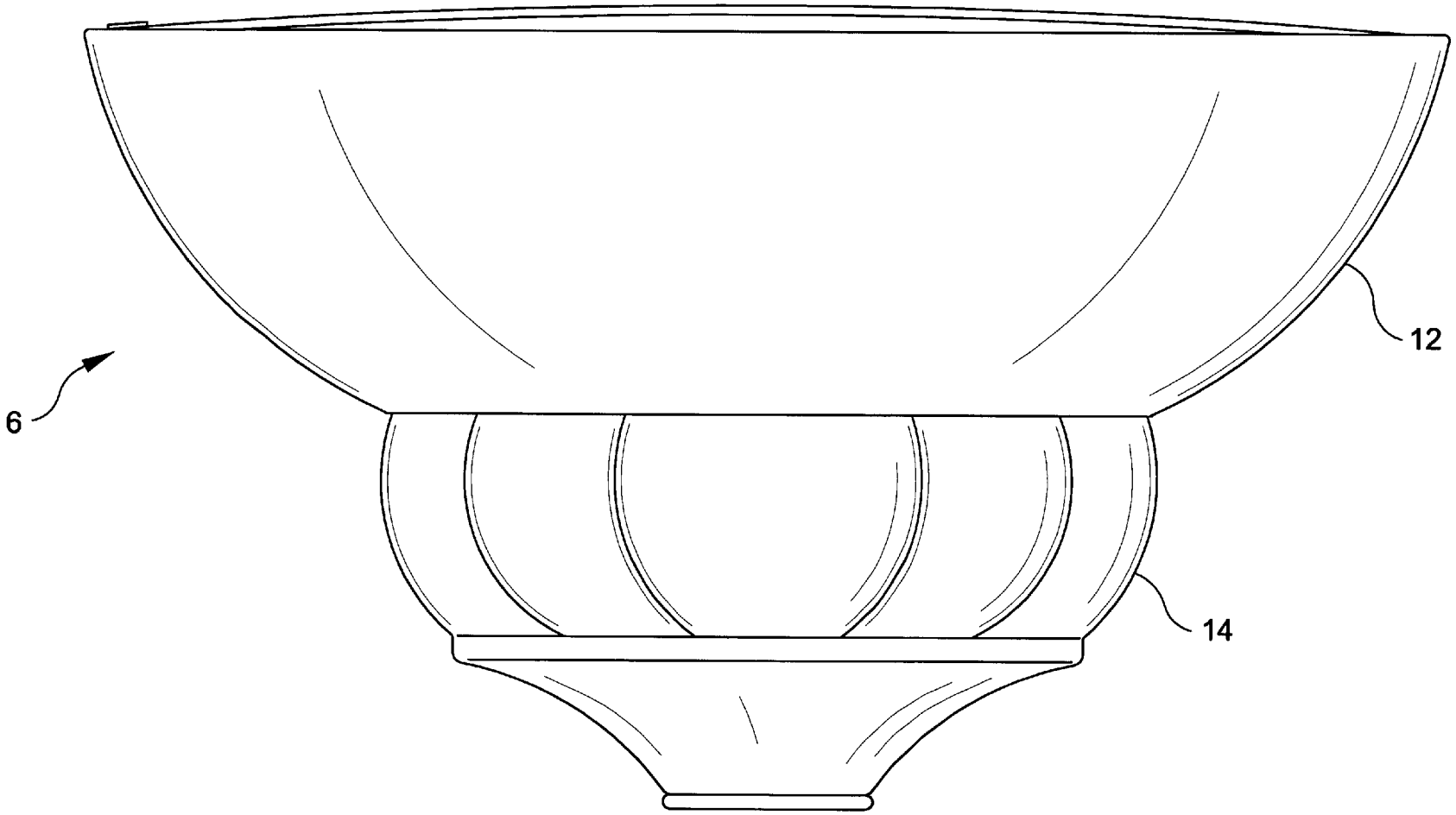
FIG. 11 is a side elevational view of an alternative design for the shade assembly of a torchiere-style floor lamp formed in accordance with the present invention.
Figure 12:
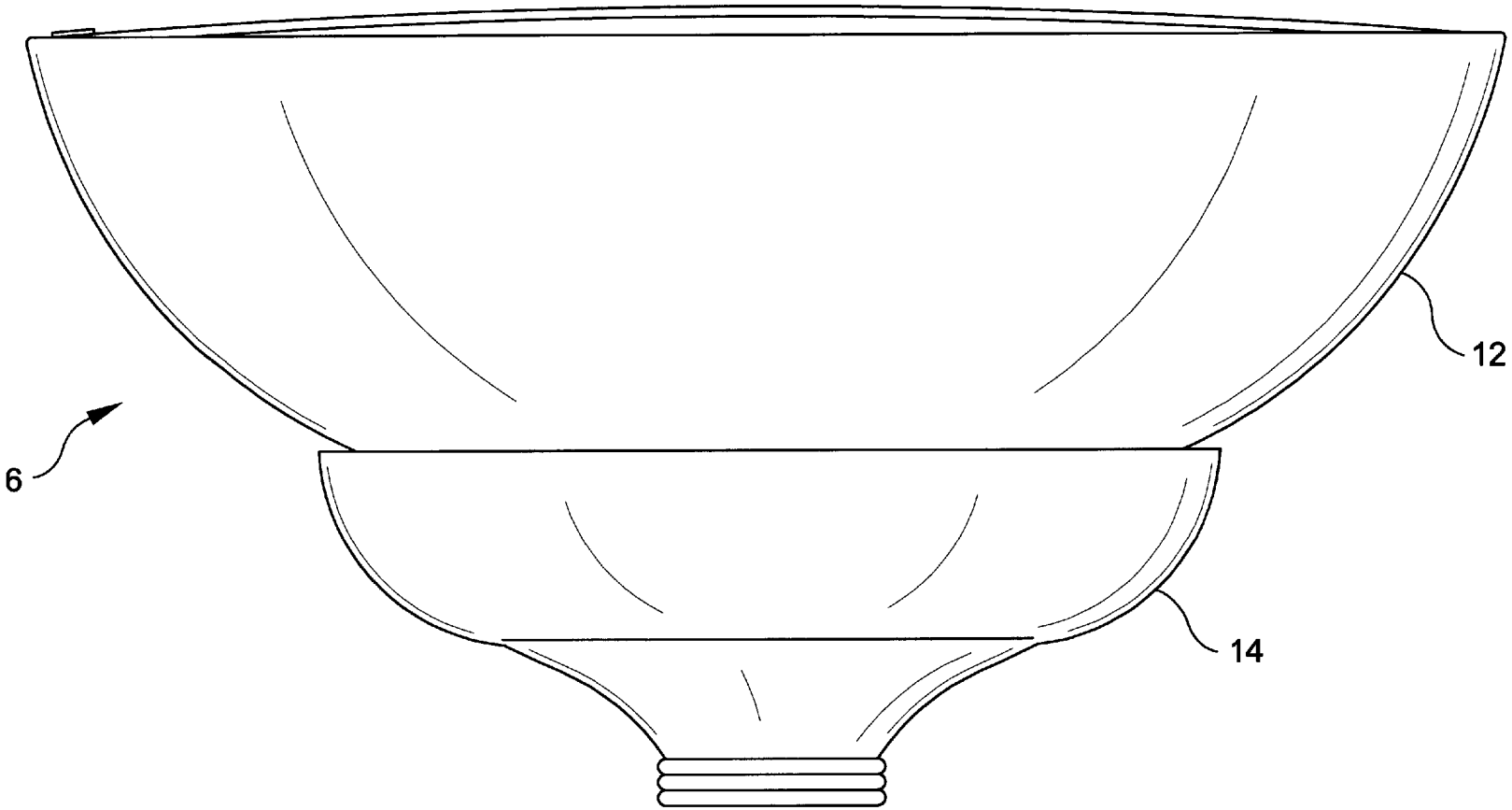
FIG. 12 is a side elevational view of an alternative design for the shade assembly of a torchiere-style floor lamp formed in accordance with the present invention.
Figure 13:
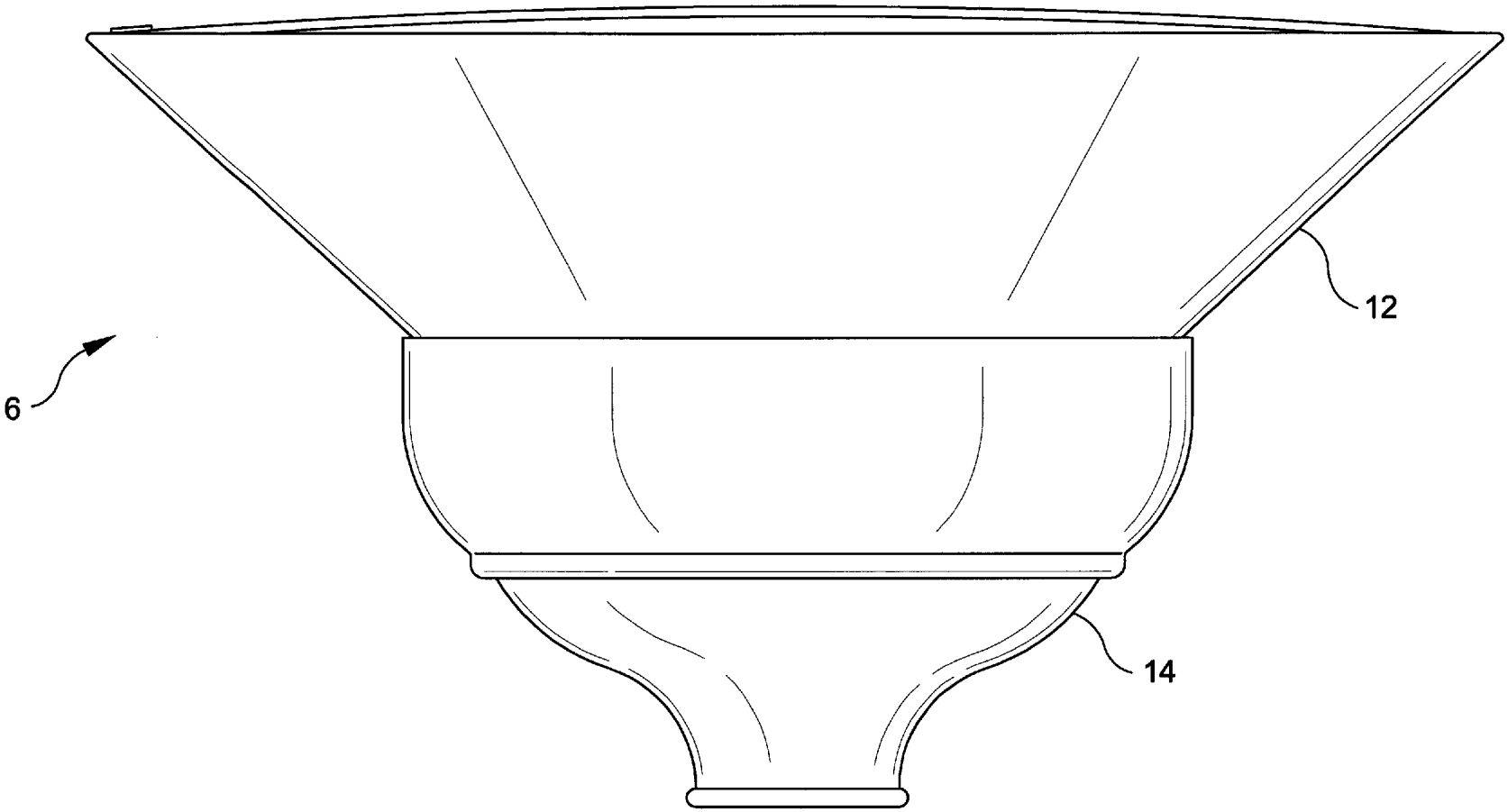
FIG. 13 is a side elevational view of an alternative design for the shade assembly of a torchiere-style floor lamp formed in accordance with the present invention.
Figure 14:
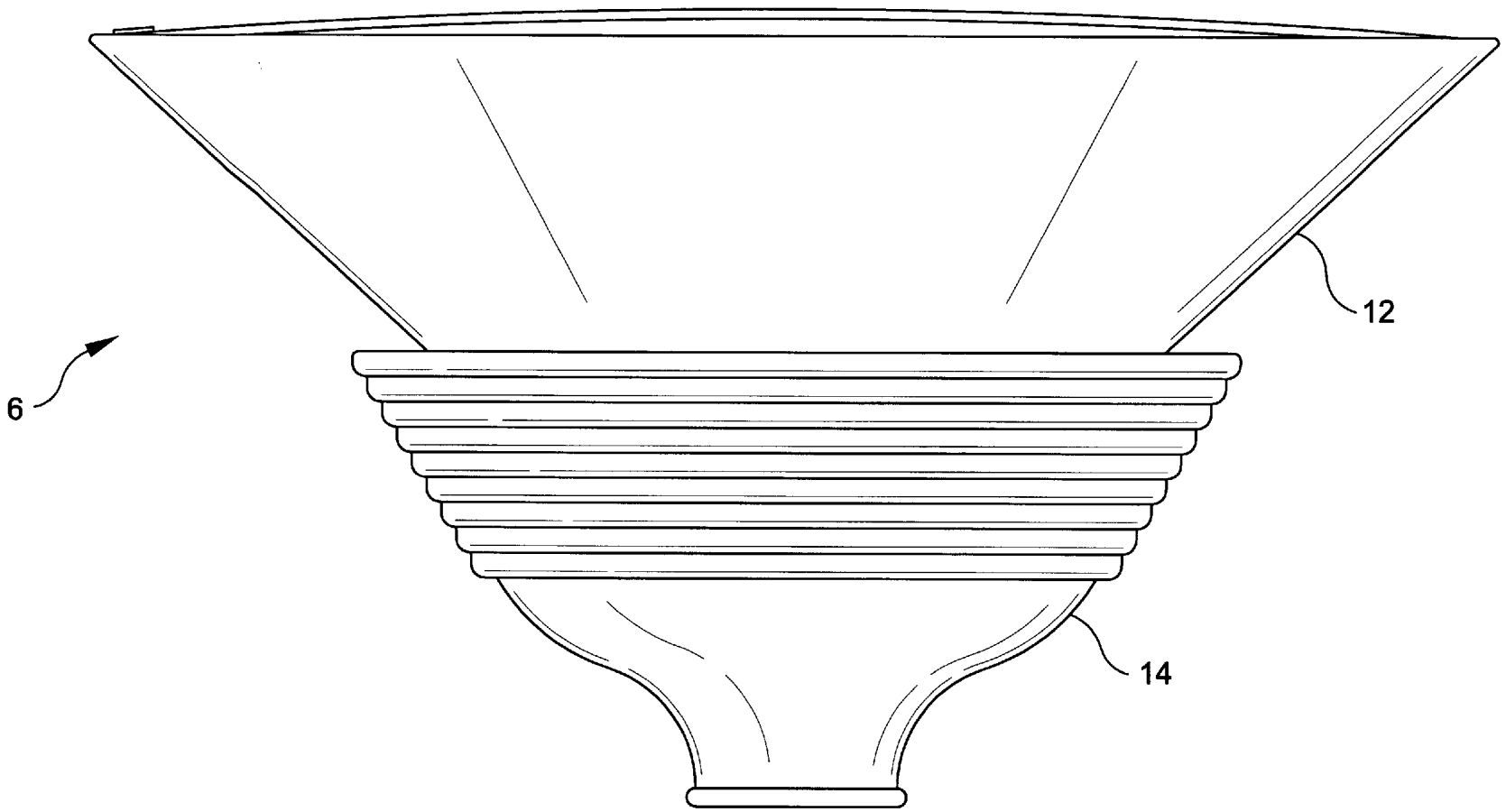
FIG. 14 is a side elevational view of an alternative design for the shade assembly of a torchiere-style floor lamp formed in accordance with the present invention.

Referring to the third step illustrated in FIG. 9, for purposes of packing, the disassembled and rearranged upper and lower shade portions are placed into one of two circular formed recesses, 46, 48 in a styrofoam packing insert 44. The other circular recess is dimensioned to receive the lamp base 2. Additionally, the disassembled stem 4 now in three sections is placed along the sides of the package insert 44 as clearly illustrated in FIG. 10. The arrangement of components within the package insert 44 is substantially the same as prior art halogen lamps except for the disassembly and rearrangement of the shade assembly 6. To complete the packaging, a styrofoam top (not shown) similar to a shoe box top is provided to be fitted over the package insert 44. Finally, the package insert 44 and top are placed within a folded cardboard box (not shown) for shipping and display within a store.

The design of the present invention for packaging is very effective. Specifically, current torchiere-style floor lamps which do not meet the proposed U.L. 153 requirements are packaged in a box having the following dimensions: 13½" wide×4⅞" deep×24¼" long, i.e., approximately 0.93 cubic feet in volume. Approximately 2,250 packages will fit into a standard 40 foot shipping container used for transporting such goods. Assuming a new torchiere design which will meet the requirements of proposed U.L. 153 for distance from the containment barrier to a point on the guard that combustibles are able to contact which does not utilize the two-piece shade design of the present invention, it is estimated that the packaging for the lamp would have the following dimensions: 13½" wide×6"–7" deep×24¾" long and only approximately 1,860 packages or less would fit into a standard shipping container. Accordingly, the cost of packaging and shipping such products would increase significantly. The present invention provides a lamp design which meets or exceeds all proposed U.L. 153 changes yet still fits substantially into the "old" package. By utilizing the attached flat guard and two-piece shade assembly which can be disassembled for purposes of packaging. The lamp of the present invention fits into a box approximately 0.97 cubic feet in volume and approximately 2,230 pieces will fit into a standard 40 foot shipping container. Accordingly, the packaging for the torchiere-style floor lamp of the present invention remains substantially unchanged from that currently being used for lamps which do not meet the proposed U.L. 153 requirements.

FIGS. 11–14 each illustrate various different decorative designs of the shade assembly suitable for use in the present invention. Each design is similar to that illustrated in FIGS. 1–3 in that the lamp socket, bulb and reflector are positioned within a lower shade portion 14 of the shade assemblies 6 to create the desired distance between the glass bulb containment barrier 28 to the wire guard extending across the open upper end of the upper shade portion 12 in accordance with the proposed U.L. requirements, U.L. 153. Furthermore, each design would incorporate each of the safety features discussed above including the safety switch to ensure proper assembly of the shade assembly 6 prior to operation of the lamp.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A lamp comprising:

a base for supporting the lamp on a surface;

a shade assembly;

a stem having a first end extending upwardly from said base and a second end of the stem supporting the shade assembly; wherein the shade assembly comprises at least a shade support and an upper shade portion attachable to said shade support and forming an interface therebetween;

a light socket positioned within the shade assembly; and an electrical circuit for providing power to said light socket, said electrical circuit including a safety interface device positioned at the interface of said shade support and upper shade portion whereby the electrical circuit is substantially an open circuit unable to provide power to the light socket unless said upper shade portion is mounted on said shade support.

2. The lamp as defined in claim 1, wherein the safety interface device comprises one of a switch and an electrical connector.

3. The lamp is defined in claim 2, wherein the switch is a push-button switch.

4. The lamp as defined in claim 2, wherein the switch includes an actuator and the switch is a pressure sensitive switch requiring a predetermined force applied to the actuator to effect a change of conductive state of said switch.

5. The lamp as defined in claim 2, wherein the electrical connector includes a plug portion mounted to one of the upper shade portion and lower shade support and a recetacle portion mounted to the other of the upper shade portions and lower shade support.

6. The lamp as defined in claim 1, wherein the stem comprises an elongated pole and the shade assembly comprises a substantially open-ended bowl-shape.

7. The lamp as defined in claim 6, further including a grille mounted across the open-ended shade assembly.

8. The lamp as defined in claim 7, further including a glass shield extending substantially across said light socket and wherein the distance from a center point of the glass shield to the closest point of the grill is at least 3 inches.

9. The lamp as defined in claim 8, wherein the grill is substantially flat and permanently hinged to the shade assembly.

10. The lamp as defined in claim 1, wherein the electrical circuit further includes a thermostat for sensing air temperature within the shade assembly, said thermostat terminating power to the light socket in response to sensed air temperature reaching a predetermined value.

11. The lamp as defined in claim 1, wherein the electrical circuit further includes a tilt switch for sensing an angle of tilt of said lamp with respect to a substantially horizontal support surface, said tilt switch terminating power to the light socket in response to the lamp being tilted beyond a predetermined angle with respect to said support surface.

12. A halogen torchiere-style floor lamp comprising:

a base for supporting the lamp on the floor;

an upwardly directed shade assembly having a top opening to permit light and heat to be directed outwardly therefrom;

an elongated pole extending between and connecting the base to the shade assembly;

a light socket supported within the shade assembly; and an electrical circuit for providing power to the light socket; wherein said shade assembly comprises a lower shade support portion and an upper shade portion and forming an interface therebetween, said upper shade portion being removably attachable to said lower shade support portion; and wherein the electrical circuit includes a safety interface device provided at the interface of said lower shade support portion and said upper shade portion whereby power to the light socket is terminated unless said upper shade portion is mounted to said lower shade support portion.

13. The halogen torchiere-style floor lamp as defined in claim 12, further comprising a wire guard hingedly positionable over an opening of the shade assembly.

14. The halogen torchiere-style floor lamp as defined in claim 13, wherein the wire guard is substantially flat.

15. The halogen torchiere-style floor lamp as defined in claim 12, wherein the safety interface device comprises a switch supported on one of said lower shade support portion and said upper shade portion.

16. The halogen torchiere-style floor lamp as defined in claim 15, wherein the switch includes a pressure-sensitive actuator that requires a predetermined force applied to the actuator to effect a change of conductive state of said switch.

17. The halogen torchiere-style floor lamp as defined in claim 15, wherein the switch is mounted on the lower shade support and the switch includes an actuator engageable by the upper shade portion when the shade assembly is assembled.

18. The halogen torchiere-style floor lamps as defined in claim 12, wherein the safety interface device comprises an electrical connector including a plug portion and a receptacle portion.

19. The halogen torchiere-style floor lamp as defined in claim 12, wherein the electrical circuit further includes a temperature-sensitive switch for sensing air temperature within the shade assembly, said temperature-sensitive switch terminating power to the light socket in response to sensed air temperature reaching a predetermined value.

20. The halogen torchiere-style floor lamp as defined in claim 12, wherein the electrical circuit further includes a tilt switch for sensing an angle of tilt of said lamp with respect to a substantially horizontal support surface, said tilt switch terminating power to the light socket in response to the lamp being tilted beyond a predetermined angle with respect to said support surface.

21. The halogen torchiere-style floor lamp as defined in claim 12, further including a wire guard positioned over a portion of an opening of the shade assembly and a glass shield supported across said light socket and wherein the distance from a center point of the glass shield to the closest point of the grill is at least 3 inches.

22. The halogen torchiere-style floor lamp as defined in claim 21, wherein a minimum distance from an end of the glass shield to any point on the grill is at least 2⅜ inches.

23. The halogen torchiere-style floor lamp as defined in claim 22, wherein the lamp is able to be disassembled and arranged to fit within a package having a volume less than one cubic foot.

24. The halogen torchiere-style floor lamp as defined in claim 22, wherein the lamp is able to be disassembled and arranged to fit within a package having a width less than six inches.

25. A fire-safe halogen torchiere floor lamp, wherein the lamp comprises a lampshade assembly mounted at one end of an elongated stem and having an opening forcing upward, a base mounted to an opposite end of the stem, a halogen bulb mounted within the lampshade assembly and a containment barrier shield at least partially covering the bulb, wherein the lampshade assembly comprises a lower shade portion and an upper shade portion the upper and lower shade portions forming an interface therebetween said upper shade portion being removably attachable to said lower shade portion; and a normally open circuit safety interface device electrically coupled to the halogen bulb, the safety interface device being positioned between the lower shade portion and upper shade portion whereby power to the halogen bulb is only supplied when the upper shade portion is mounted on the lower shade portion thereby changing a conductive state of the switch device to a closed circuit.

26. The fire-safe halogen torchiere floor lamp as defined in claim 25, further including a wire guard extending over a portion of the lampshade assembly opening.

27. The fire-safe halogen torchiere floor lamp as defined in claim 26, wherein the distance measured from a midpoint on a length of the halogen bulb, measured from a top of the containment barrier shield to the wire guard is at least 3 inches and the distance measured from an end of the containment barrier shield to any point on the wire guard is at least 2% inches.

28. The fire-safe halogen torchiere floor lamp as defined in claim 27, wherein the wire guard is substantially flat and affixed to the upper shade portion via a hinge.

29. The fire-safe halogen torchiere floor lamp as defined in claim 27, wherein the lamp is capable of being disassembled and arranged to fit within a package having a volume of less than one cubic foot.

30. The fire-safe halogen torchiere floor lamp as defined in claim 27, wherein the lamp is capable of being disassembled and arranged to fit within a package having a width less than six inches.

31. A lamp comprising:

a base for supporting the lamp on a surface;

a shade assembly;

a stem having a first end extending upwradly from said base and a second end of the stem supporting the shade assembly, wherein the shade assembly comprises at least a lower shade portion and an upper shade portion attachable to said lower shade portion;

a light socket positioned within the shade and a light bulb positioned therein; and an electrical circuit for providing power to said light socket to illuminate said light bulb; said electrical circuit including means for determining whether the lower shade portion and upper shade portion are properly assembled such that said determining means permits power to flow to said light socket to illuminate said light bulb only when said shade assembly is properly assembled.

32. A lamp as defined in claim 31, wherein the determining means comprises an interface safety device positioned at an interface formed between the assembled lower shade portion and upper shade portion.

33. A lamp as defined in claim 32, wherein the interface safety device comprises one of a switch and an electrical connector.

* * * * *